US005470405A

United States Patent [19]

Wyatt-Mair et al.

[11] Patent Number: 5,470,405

[45] Date of Patent: Nov. 28, 1995

[54] METHOD OF MANUFACTURING CAN BODY SHEET

[75] Inventors: Gavin F. Wyatt-Mair, Lafayette; Donald G. Harrington, Danville, both of Calif.

[73] Assignee: Kaiser Aluminum & Chemical Corporation, Pleasanton, Calif.

[21] Appl. No.: 248,555

[22] Filed: May 24, 1994

Related U.S. Application Data

[63] Continuation of Ser. No. 902,936, Jun. 23, 1992, abandoned.

[51] Int. Cl.[6] ..... C22F 1/04

[52] U.S. Cl. ..... 148/551; 148/552; 148/693; 148/697; 148/439; 148/440

[58] Field of Search ..... 148/551, 552, 148/693, 697, 417, 439, 440; 164/459, 462, 476, 477

[56] References Cited

U.S. PATENT DOCUMENTS

| | | | |
|---|---|---|---|
| 4,282,044 | 8/1981 | Robertson et al. | 148/552 |
| 4,582,541 | 4/1986 | Dean et al. | 148/551 |
| 4,976,790 | 12/1990 | McAuliffe et al. | 148/551 |

*Primary Examiner*—David A. Simmons
*Assistant Examiner*—Robert R. Koehler
*Attorney, Agent, or Firm*—Rockey, Rifkin and Ryther

[57] ABSTRACT

A method for manufacturing aluminum alloy can body stock including a continuous, in-line sequence of hot rolling, annealing and solution heat treating without intermediate cooling and rapid quenching.

30 Claims, 4 Drawing Sheets

ALL IN LINE FLAT SHEET PRODUCTION

PREFERRED EMBODIMENT

METHOD OF MANUFACTURING CAN BODY SHEET

This is a continuation of application Ser. No. 07/902,936 filed on Jun. 23, 1992, now abandoned.

BACKGROUND OF THE INVENTION

The present invention relates to a continuous in-line process for economically and efficiently producing aluminum alloy beverage can body stock.

PRIOR ART

It is now conventional to manufacture aluminum cans such as beverage cans in which sheet stock of aluminum in wide widths (for example, 60 inches) is first blanked into a circular configuration and cupped, all in a single operation. The sidewalls are then drawn and ironed by passing the cup through a series of dies having diminishing bores. The dies thus produce an ironing effect which lengthens the sidewall to produce a can body thinner in dimension than its bottom. The resulting can body has thus been carefully designed to provide a shape yielding maximum strength and minimum metal.

There are three characteristics that are common to prior art processes for manufacturing can body stock: a) the width of the body stock is wide (typically greater than 60 inches), b) the body stock is produced by large plants employing large sophisticated machinery and c) the body stock is packaged and shipped long distances to can making customers. Can stock in wide widths suitable for utilization by current can makers has necessarily been produced by a few large, centralized rolling plants. Such plants typically produce many products in addition to can body stock, and this necessitates the use of flexible manufacturing on a large scale, with attendant cost and efficiency disadvantages. The width of the product necessitates the use of large-scale machinery in all areas of the can stock producing plants, and the quality requirements of can body stock, as well as other products, dictate that this machinery be sophisticated. Such massive, high-technology machinery represents a significant economic burden, both from a capital investment and an operating cost perspective. Once the can body stock has been manufactured to finish gauge as described in detail hereinafter, it is carefully packaged to seal against moisture intrusion for shipment to customer's can making facilities. These facilities are typically located remote from the can stock manufacturers' plant; indeed, in many cases they are hundreds or even thousands of miles apart. Packaging, shipping, and un-packaging therefore represent a further significant economic burden, especially when losses are due to handling damage, atmospheric conditions, contamination and misdirection are added. The amount of product in transit adds significant inventory cost to the prior art process.

Conventional manufacturing of can body stock employs batch processes which include an extensive sequence of separate steps. In the typical case, a large ingot is cast and cooled to ambient temperature. The ingot is then stored for inventory management. When an ingot is needed for further processing, it is first treated to remove defects such as segregation, pits, folds, liquation and handling damage by machining of its surfaces. This operation is called scalping. Once the ingot has surface defects removed, it is heated to a required homogenization temperature for several hours to ensure that the components of the alloy are uniformly distributed through the metallurgical structure, and then cooled to a lower temperature for hot rolling. While it is still hot, the ingot is subjected to breakdown hot rolling in a number of passes using reversing or non-reversing mill stands which serve to reduce the thickness of the ingot. After breakdown hot rolling, the ingot is then typically supplied to a tandem mill for hot finishing rolling, after which the sheet stock is coiled, air cooled and stored. The coil may be annealed in a batch step. The coiled sheet stock is then further reduced to final gauge by cold rolling using unwinders, rewinders and single and/or tandem rolling mills.

Batch processes typically used in the aluminum industry require many different material handling operations to move ingots and coils between what are typically separate processing steps. Such operations are labor intensive, consume energy, and frequently result in product damage, re-working of the aluminum and even wholesale scrapping of product. And, of course, maintaining ingots and coils in inventory also adds to the manufacturing cost.

Aluminum scrap is generated in most of the foregoing steps, in the form of scalping chips, end crops, edge trim, scrapped ingots and scrapped coils. Aggregate losses through such batch processes typically range from 25 to 40%. Reprocessing the scrap thus generated adds 25 to 40% to the labor and energy consumption costs of the overall manufacturing process.

It has been proposed, as described in U.S. Pat. Nos. 4,260,419 and 4,282,044, to produce aluminum alloy can stock by a process which uses direct chill casting or minimill continuous strip casting. In the process there described, consumer aluminum can scrap is remelted and treated to adjust its composition. In one method, molten metal is direct chill cast followed by scalping to eliminate surface defects from the ingot. The ingot is then preheated, subjected to hot breakdown rolling followed by continuous hot rolling, coiling, batch annealing and cold rolling to form the sheet stock. In another method, the casting is performed by continuous strip casting followed by hot rolling, coiling and cooling. Thereafter, the coil is annealed and cold rolled. The minimill process, as described above, requires about ten material handling operations to move ingots and coils between about nine process steps. Like other conventional processes described earlier, such operations are labor intensive, consume energy and frequently result in product damage. Scrap is generated in the rolling operations resulting in typical losses throughout the process of about 10 to 20%.

In the minimill process, annealing is typically carried out in a batch fashion with the aluminum in coil form. Indeed, the universal practice in producing aluminum alloy flat rolled products has been to employ slow air cooling of coils after hot rolling. Sometimes the hot rolling temperature is high enough to allow recrystallization of the hot coils before the aluminum cools down. Often, however, a furnace coil batch anneal must be used to effect recrystallization before cold rolling. Batch coil annealing as typically employed in the prior art requires several hours of uniform heating and soaking to achieve recrystallization. Alternatively, after breakdown cold rolling, prior art processes frequently employ an intermediate anneal operation prior to finish cold rolling. During slow cooling of the coils following annealing, some alloying elements which had been in solid solution in the aluminum will precipitate, resulting in reduced strength attributable to solid solution hardening.

The foregoing patents (U.S. Pat. No. 4,260,419; and U.S. Pat. No. 4,292,044) employ batch coil annealing, but suggest the concept of flash annealing in a separate processing line. These patents suggest that it is advantageous to slow cool the alloy after hot rolling and then reheat it as part of a flash annealing process. That flash annealing operation has been criticized in U.S. Pat. No. 4,614,224 as not economical.

There is thus a need to provide a continuous, in-line process for producing aluminum alloy can body stock which avoids the unfavorable economics embodied in conventional processes of the type described.

It is accordingly an object of the present invention to provide a process for producing aluminum alloy can body stock which can be carried out in a continuous fashion without the need to employ separate batch operations.

It is a more specific object of the invention to provide a process for commercially producing an aluminum alloy can body stock in a continuous process which can be operated economically and provide a product having equivalent or better metallurgical properties needed for can making.

These and other objects and advantages of the invention appear more fully hereinafter from a detailed description of the invention.

SUMMARY OF THE INVENTION

The concepts of the present invention reside in the discovery that it is possible to combine casting, hot rolling, annealing, and solution heat treating, quenching and cold rolling into one continuous in-line operation for the production of aluminum alloy can body stock. As used herein, the term "anneal" refers to a heating process that causes recrystallization of the metal to occur, producing uniform formability and assisting in earing control. Annealing time as referred to defines the total time required to heat up the material and complete the annealing. Also, as used herein, the term "solution heat treatment" refers to a metallurgical process of dissolving alloying elements into solid solution and retaining elements in solid solution for the purpose of strengthening the final product. Furthermore, the term "flash annealing" as used herein refers to an anneal or solution heat treatment that employs rapid heating of a strip as opposed to a slowly heated coil. The continuous operation in place of batch processing facilitates precise control of process conditions and therefore metallurgical properties. Moreover, carrying out the process steps continuously and in-line eliminates costly materials handling steps, in-process inventory and losses associated with starting and stopping the processes.

The process of the present invention thus involves a new method for the manufacture of aluminum alloy can body stock utilizing the following process steps in one, continuous in-line sequence:

(a) In the first step, a hot aluminum feedstock is provided, as by strip casting;

(b) The feedstock is hot rolled to reduce its thickness;

(c) The hot reduced feedstock is thereafter annealed and solution heat treated without substantial intermediate cooling;

(d) The annealed and solution heat treated feedstock is thereafter immediately and rapidly quenched to a temperature suitable for cold rolling; and (e) The quenched feedstock is, in the preferred embodiment, subjected to cold rolling to produce can body sheet stock having desired thickness and metallurgical properties.

In accordance with a preferred embodiment of the invention, the strip is fabricated by strip casting to produce a cast thickness less than 1.0 inches, and preferably within the range of 0.1 to 0.2 inches.

In another preferred embodiment, the width of the strip, slab or plate is narrow, contrary to conventional wisdom; this facilitates ease of in-line threading and processing, minimizes investment in equipment and minimizes cost in the conversion of molten metal to can body stock.

In a further preferred embodiment, resulting favorable capacity and economics mean that small dedicated can stock plants may conveniently be located at can-making facilities, further avoiding packaging and shipping of can stock and scrap web, and improving the quality of the can body stock as seen by the can maker.

DETAILED DESCRIPTION OF THE INVENTION

In the preferred embodiment, the overall process of the present invention embodies three characteristics which differ from the prior art processes;

(a) The width of the can body stock product is narrow;

(b) The can body stock is produced by utilizing small, in-line, simple machinery; and (c) The said small can stock plants are located in or adjacent to the can making plants, and therefore packaging and shipping operations are eliminated.

The in-line arrangement of the processing steps in a narrow width (for example, 12 inches) makes it possible for the invented process to be conveniently and economically located in or adjacent to can production facilities. In that way, the process of the invention can be operated in accordance with the particular technical and throughput needs for can stock of can making facilities. Furthermore, elimination of shipping mentioned above leads to improved overall quality to the can maker by reduced traffic damage, water stain and lubricant dryout; it also presents a significant reduction in inventory of transportation palettes, fiber cores, shrink wrap, web scrap and can stock. Despite the increased number of cuppers required in the can maker's plant to accommodate narrow sheet, overall reliability is increased and cupper jams are less frequent because the can body stock is narrow.

Figure 1:
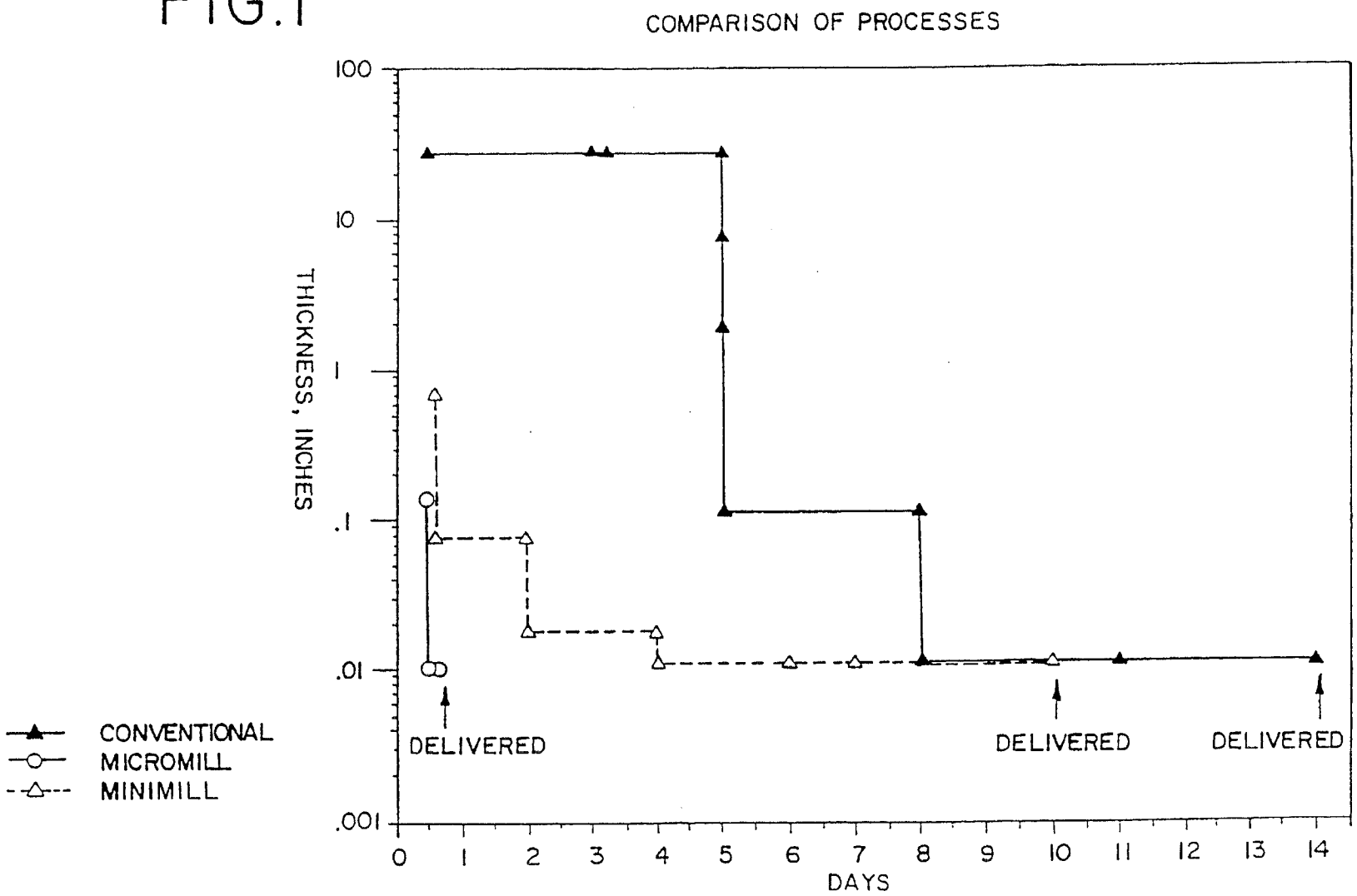
FIG. 1 is a plot of in-process thickness versus time for conventional minimill, and the "micromill" process of the present invention.
Figure 2:
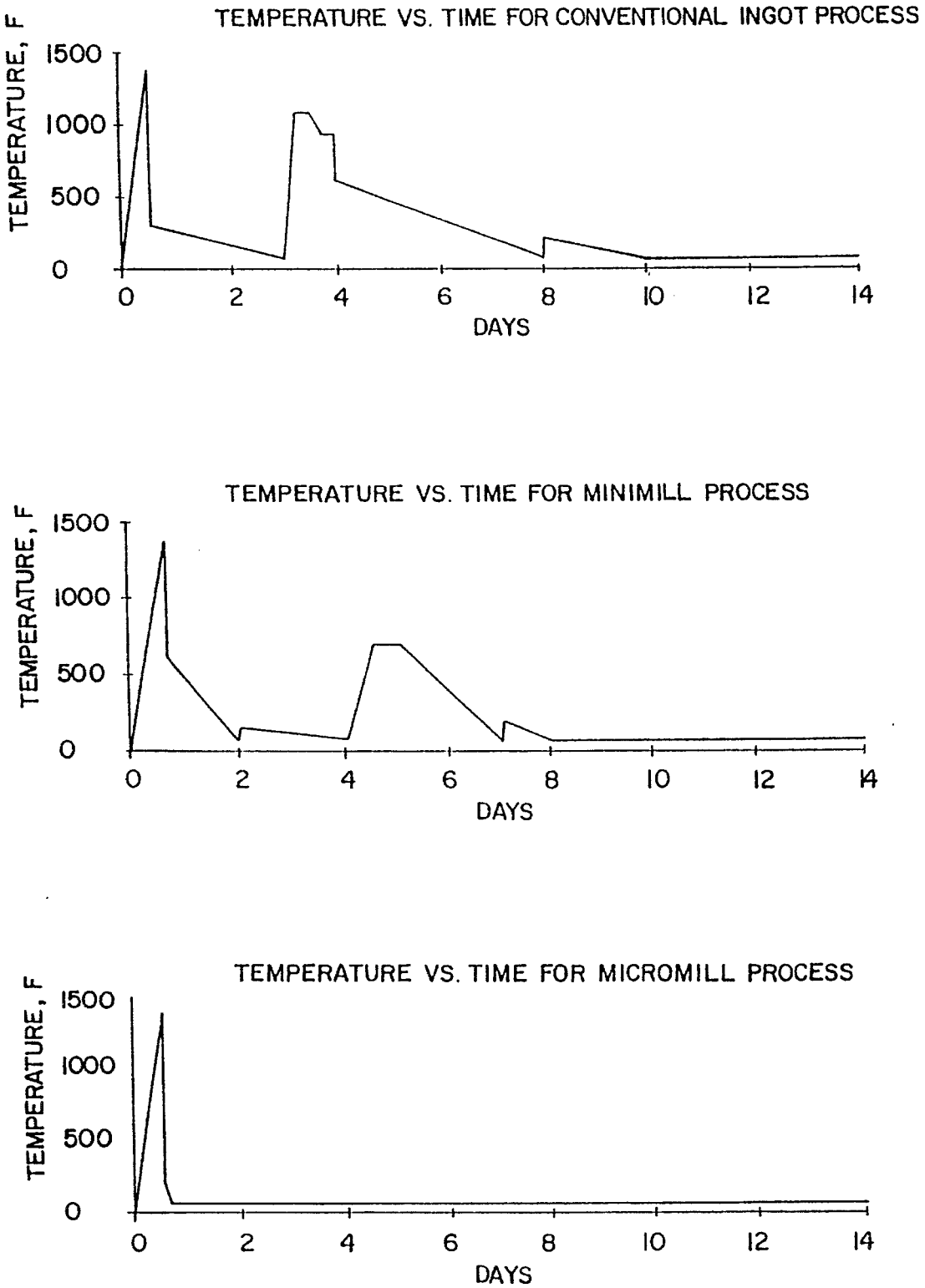
FIG. 2 is a plot of temperature versus time for the present invention, referred to as the micromill process, as compared to two prior art processes.

As can be seen from the foregoing prior art patents, the batch processing technique involves fourteen separate steps while the minimill prior art processing involves about nine separate steps, each with one or more handling operations. The present invention is different from that prior art by virtue of in-line flow of product through the fabrication operations involving only two or three steps and the metallurgical differences that the method produces. FIG. 1 shows the thickness of in-process product during manufacture for conventional, minimill, and micromill processes. The conventional method starts with up to 30-in.-thick ingots and takes 14 days. The minimill process starts at 0.75-in.-thick and takes 9 days. The micromill process starts at 0.140-in. and takes ½ day (most of which is the melting cycle, since the in-line process itself takes only about two minutes). The symbols in FIG. 1 represent major processing and/or handling steps. FIG. 2 compares typical in-process product temperature for three methods of producing can body stock. In the conventional ingot method, there is a period for melting followed by a rapid cool during casting with a slow cool to room temperature thereafter. Once the scalping process is complete, the ingot is heated to an homogenization temperature before hot rolling. After hot rolling, the product is again cooled to room temperature. At this point, it is assumed in the figure that the hot rolling temperature and slow cool were sufficient to anneal the product. However, in some cases, a batch anneal step of about 600° F. is needed at about day 8 which extends the total process schedule an additional two days. The last temperature increase is associated with cold rolling, and it is allowed to cool to room temperature.

In the minimill process, there is again a period by melting, followed by rapid cooling during slab casting and hot rolling, with a slow cool to room temperature thereafter. Temperature is raised slightly by breakdown cold rolling and the product is allowed to cool again slowly before being heated for batch annealing. After batch annealing, it is cooled slowed to room temperature. The last temperature increase is associated with cold rolling and it is allowed to cool to room temperature.

In the micromill process of the preferred embodiment of the present invention, there is a period for melting, followed by a rapid cool during strip casting and hot rolling. The in-line anneal step raises the temperature, and then the product is immediately quenched, cold rolled and allowed to cool to room temperature.

As can be seen from FIG. 2, the present invention differs substantially from the prior art in duration, frequency and rate of heating and cooling. As will be appreciated by those skilled in the art, these differences represent a significant departure from prior art practices for manufacturing aluminum alloy can body sheet.

Figure 3:
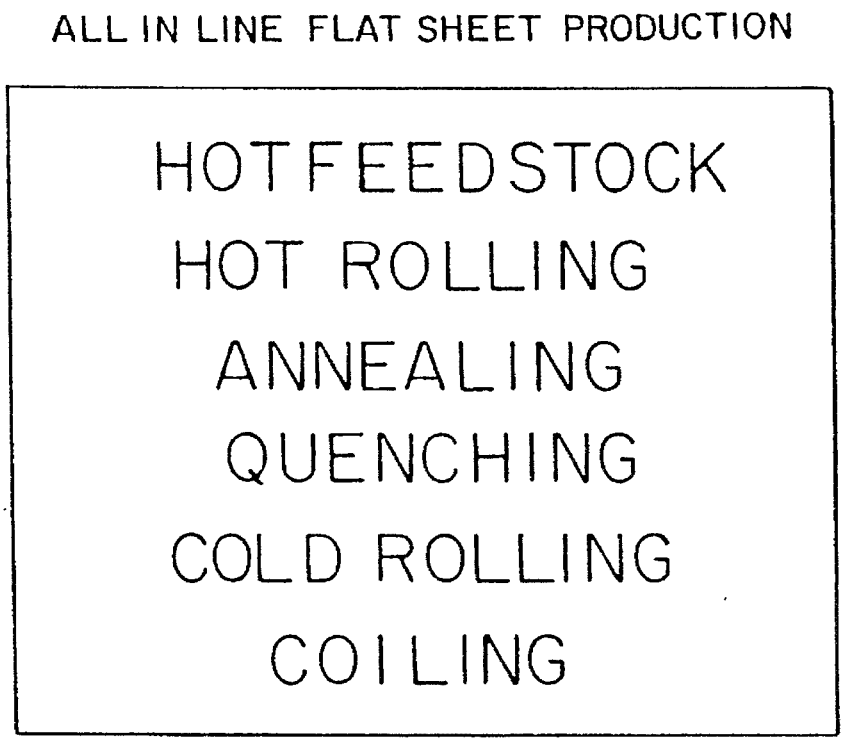
FIG. 3 is a block diagram showing the all-in-line process of the present invention for economical production of aluminum can body sheet.
Figure 4:
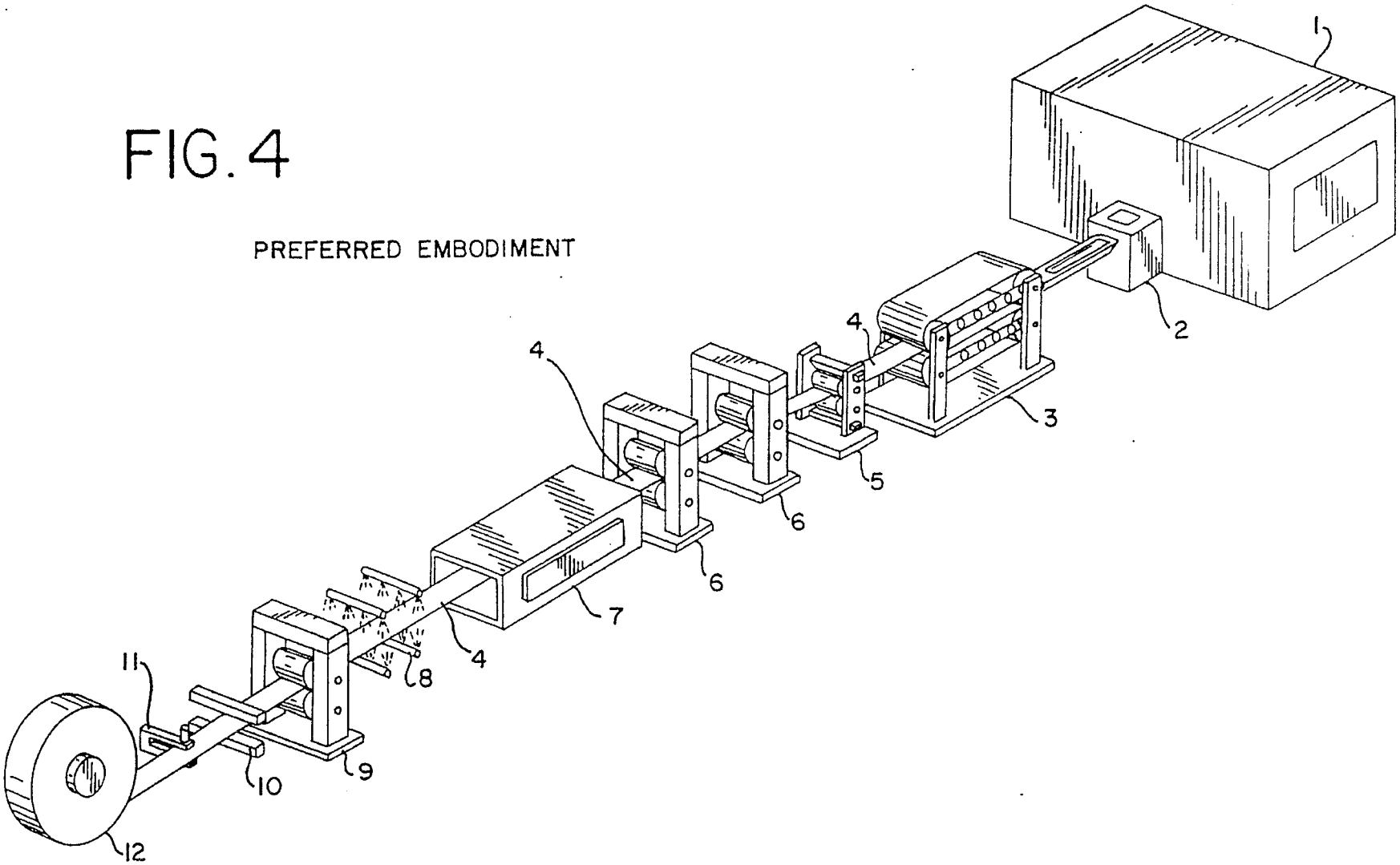
FIG. 4 shows a schematic illustration of the present invention with all-in-line processing from casting throughout finish cold rolling.

In the preferred embodiment of the invention as illustrated in FIGS. 3 and 4, the sequence of steps employed in the practice of the present invention is illustrated. One of the advances of the present invention is that the processing steps for producing can body sheet can be arranged in one continuous line whereby the various process steps are carried out in sequence. Thus, numerous handling operations are entirely eliminated.

In the preferred embodiment, molten metal is delivered from a furnace 1 to a metal degassing and filtering device 2 to reduce dissolved gases and particulate matter from the molten metal, as shown in FIG. 4. The molten metal is immediately converted to a cast feedstock 4 in casting apparatus 3. As used herein, the term "feedstock" refers to any of a variety of aluminum alloys in the form of ingots, plates, slabs and strips delivered to the hot rolling step at the required temperatures. Herein, an aluminum "ingot" typically has a thickness ranging from about 6 inches to about 30 inches, and is usually produced by direct chill casting or electromagnetic casting. An aluminum "plate", on the other hand, herein refers to an aluminum alloy having a thickness from about 0.5 inches to about 6 inches, and is typically produced by direct chill casting or electromagnetic casting alone or in combination with hot rolling of an aluminum alloy. The term "slab" is used herein to refer to an aluminum alloy having a thickness ranging from 0.375 inches to about 3 inches, and thus overlaps with an aluminum plate. The term "strip" is herein used to refer to an aluminum alloy, typically having a thickness less than 0.375 inches. In the usual case, both slabs and strips are produced by continuous casting techniques well known to those skilled in the art.

The feedstock employed in the practice of the present invention can be prepared by any of a number of casting techniques well known to those skilled in the art, including twin belt casters like those described in U.S. Pat. No. 3,937,270 and the patents referred to therein. In some applications, it is desirable to employ as the technique for casting the aluminum strip the method and apparatus described in co-pending application Ser. No. 07/902,997, filed concurrently herewith, the disclosure of which is incorporated herein by reference.

The present invention contemplates that any one of the above physical forms of the aluminum feedstock may be used in the practice of the invention. In the most preferred embodiment, however, the aluminum feedstock is produced directly in either slab or strip form by means of continuous casting.

The feedstock 4 is moved through optional pinch rolls 5 into hot rolling stands 6 where its thickness is decreased. The hot reduced feedstock 4 exits the hot rolling stands 6 and is then passed to heater 7.

Heater 7 is a device which has the capability of heating the reduced feedstock 4 to a temperature sufficient to rapidly anneal and solution heat treat the feedstock 4.

It is an important concept of the invention that the feedstock 4 be immediately passed to the heater 7 for annealing and solution heat treating while it is still at an elevated temperature from the hot rolling operation of mills 6. In contrast to the prior art teaching that slow cooling following hot rolling is metallurgically desirable, it has been discovered in accordance with the present invention that it is not only more efficient to heat the feedstock 4 immediately after hot rolling to effect anneal and solution heat treatment but it also provides much improved metallurgical properties over conventional batch anneal and equal or better metallurgical properties compared to off-line flash anneal. Immediately following the heater 7 is a quench station 8 where the feedstock 4 is rapidly cooled by means of a cooling fluid to a temperature suitable for cold rolling. In the most preferred embodiment, the feedstock 4 is passed from the quenching station to one or more cold rolling stands 9 where the feedstock 4 is worked to harden the alloy and reduce its thickness to finish gauge. After cold rolling, the strip or slab 4 is coiled on a coiler 12.

As will be appreciated by those skilled in the art, it is possible to realize the benefits of the present invention without carrying out the cold rolling step as part of the in-line process. Thus, the use of the cold rolling step is an optional process step of the present invention, and can be omitted entirely or it can be carried out in an off-line fashion, depending on the end use of the alloy being processed. As a general rule, carrying out the cold rolling step off-line decreases the economic benefits of the preferred embodiment of the invention in which all of the process steps are carried out in-line.

Alternatively, it is possible, and sometimes desirable, to immediately cut blanks and produce cups for the manufacture of cans instead of coiling the strip or slab 4. Thus, in lieu of coiler 12, there can be substituted in its place a shear, punch, cupper or other fabricating device. It is also possible to employ appropriate automatic control apparatus; for example, it is frequently desirable to employ a surface inspection device 10 for on-line monitoring of surface quality. In addition, a thickness measurement device 11 conventionally used in the aluminum industry can be employed in a feedback loop for control of the process.

It has become the practice in the aluminum industry to employ wider cast strips or slabs for reasons of economy. The reasoning behind the conventional wisdom is illustrated in the following Table I, wherein the effect of wider widths on recovery in the can plant itself can be seen. "Recovery" is defined as the percentage of product weight to input materials weight.

TABLE I

| Can Plant Cupper Recovery | | |
|---|---|---|
| | Width, inches | Recovery, % |
| Prior Art | 30–80 | 85–88 |
| Present Invention | 6–20 | 68–83 |

From Table I, it seems obvious that wider width is more economical because of less scrap return in the web. However, Table II below shows what is not obvious; by combining the prior art can stock production process with the prior art can making process, the overall recovery is less than the process of the present invention.

TABLE II

| Can Stock Plant and Overall Recovery | | |
|---|---|---|
| | Can Stock Plant Recovery, % | Overall Recovery, % |
| Prior Art Conventional | 60–75 | 51–66 |
| Prior Art Minimill | 80–90 | 68–79 |
| Present Invention | 92–97 | 63–81 |

In the preferred embodiment of this invention, it has been found that, in contrast to this conventional approach, the economics are best served when the width of the cast feedstock 4 is maintained as a narrow strip to facilitate ease of processing and use of small decentralized strip rolling plants. Good results have been obtained where the cast feedstock is less than 24 inches wide, and preferably is within the range of 2 to 20 inches wide. By employing such narrow cast strip, the investment can be greatly reduced through the use of small in-line equipment, such as two-high rolling mills. Such small and economic micromills of the present invention can be located near the points of need, as, for example, can-making facilities. That in turn has the further advantage of minimizing costs associated with packaging, shipping of products and customer scrap. Additionally, the volume and metallurgical needs of the can plant can be exactly matched by the output of an adjacent can stock micromill.

It is an important concept of the present invention that annealing and solution heat treating immediately follow hot rolling of the feedstock 4 without intermediate cooling, followed by immediate quenching. The sequence and timing of process steps in combination with the heat treatment and quenching operations provide equivalent or superior metallurgical characteristics in the final product compared to ingot methods. In the prior art, the industry has normally employed slow air cooling after hot rolling. Only in some installations is the hot rolling temperature sufficient to cause annealing of the aluminum alloy before the metal cools down. It common that the hot rolling temperature is not high enough to cause annealing. In that event, the prior art has employed separate batch anneal steps before and/or after breakdown cold rolling in which the coil is placed in a furnace maintained at a temperature sufficient to cause recrystallization. The use of such furnace batch annealing operations represents a significant disadvantage. Such batch annealing operations require that the coil be heated for several hours at the correct temperature, after which such coils are typically cooled under ambient conditions. During such slow heating, soaking and cooling of the coils, some of the elements present in the aluminum which had been in solution in the aluminum are caused to precipitate (Mn, Cu, Mg, Si). That in turn results in reduced solid solution hardening and reduced alloy strength.

In contrast, the process of the present invention achieves recrystallization and retains alloying elements in solid solution for greater strength for a given cold reduction of the product. The use of the heater 7 allows the hot rolling temperature to be controlled independently from the anneal and solution heat treatment temperature. That in turn allows the use of hot rolling conditions which promote good surface finish and texture (grain orientation). In the practice of the invention, the temperature of the feedstock 4 in the heater 7 can be elevated above the hot rolling temperature without the intermediate cooling suggested by the prior art. In that way, recrystallization and solutionization can be effected rapidly, typically in less than 30 seconds, and preferably less than 10 seconds. In addition, by avoiding an intermediate cooling step, the anneal operation consumes less energy since the alloy is already at an elevated temperature following hot rolling.

In the practice of the invention, the hot rolling exit temperature is generally maintained within the range of 300° to 1000° F. while the anneal and solution heat treating are effected at a temperature within the range of 750° F. up to the solidus of the particular alloy. Times for annealing and solution heat treating range widely depending on composition, temperature, and nucleation site density, but generally can be made to fall within 1 to 120 seconds and preferably within 1–10 seconds. Immediately following heat treatment at those temperatures, the feedstock in the form of strip 4 is rapidly quenched to a temperature necessary to retain alloying elements in solid solution and to cold roll (typically less than 300° F.).

As will be appreciated by those skilled in the art, the extent of the reductions in thickness effected by the hot rolling and cold rolling operations of the present invention are subject to a wide variation, depending upon the types of feedstock employed, their chemistry and the manner in which they are produced. For that reason, the percentage reduction in thickness of each of the hot rolling and cold rolling operations of the invention is not critical to the practice of the invention. However, for a specific product, practices for reductions and temperatures must be used. In general, good results are obtainable when the hot rolling operation effects a reduction in thickness within the range of 40 to 99% and the cold rolling effects a reduction within the range of 20 to 75%.

One of the advantages of the method of the present invention arises from the fact that the preferred embodiment utilizes a thinner hot rolling exit gauge than that normally employed in the prior art. As a consequence, the method of the invention obviates the need to employ breakdown cold rolling prior to annealing.

In some cases, the hot rolling temperature can be high enough to allow in-line annealing and solution heat treating without the need for imparting additional heat to the feedstock by means of heater 7 to raise the strip temperature. In that embodiment of the invention, it is unnecessary to employ heater 7; the reduced feedstock exiting the hot rolling mills 6 is then quenched by means of quenching apparatus 8, with the same improvement in metallurgical properties. When operating in accordance with this alternative embodiment, it may be desirable to hold the reduced feedstock at an elevated temperature for a period of time to ensure recrystallization and solution heat treatment of the alloy. In the preferred embodiment, that can be conveniently accomplished by spacing the quenching apparatus 8 sufficiently downstream of the hot rolling mills 6 to permit the reduced feedstock to remain at approximately the hot rolling exit temperature for a predetermined period of time. Other holding means such as an accumulator may also be employed.

The concepts of the present invention are applicable to a wide range of aluminum alloys for use as can body stock. In general, alloys suitable for use in the practice of the present invention are those aluminum alloys containing from about 0 to about 0.6% by weight silicon, from 0 to about 0.8% by weight iron, from about 0 to about 0.6% by weight copper, from about 0.2 to about 1.5% by weight manganese, from about 0.2 to about 4% by weight magnesium, from about 0 to about 0.25% by weight zinc, with the balance being aluminum with its usual impurities. Representative of suitable alloys include aluminum alloys from the 3000 and 5000 series, such as AA 3004, AA 3104 and AA 5017.

One of the further advantages of the present invention arises from the fact that the solution heat treating without intermediate cooling allows the use of aluminum alloys having lower alloying element content, and specifically lower magnesium content. Without limiting the invention as to theory, it is believed that the process of the invention, and particularly the solution heat treatment followed by immediate quenching, causes a significant improvement in strength even though the aluminum has diminished alloy in element content. Discussions of reduced alloying elements contents may be found in U.S. Pat. Nos. 4,605,448, 4,645,544, 4,614,224, 4,582,541, and 4,411,707.

Having described the basic concepts of the invention, reference is now made to the following examples which are provided by way of illustration of the practice of the invention. The sample feedstock was as cast aluminum alloy solidified rapidly enough to have secondary dendrite arm spacings below 10 microns.

EXAMPLE 1

This example employed an alloy having the following composition within the range specified by AA 3104:

| Metal | Percent By Weight |
|---|---|
| Si | 0.26 |
| Fe | 0.44 |
| Cu | 0.19 |
| Mn | 0.91 |
| Mg | 1.10 |
| Al | Balance |

A cast strip having the foregoing composition was hot rolled from 0.140 inches to 0.026 inches in two passes. The temperature of the strip as it exited the rolling mill was 405° F. It was immediately heated to a temperature of 1000° F. for three seconds and water quenched. The alloy was 100% recrystallized at that stage.

The strip was then cold rolled to effect a 55% reduction in thickness. The tensile yield strength was 41,000 psi compared to 35,000 psi for conventionally processed aluminum having the same composition. Cups were made which had earing of 2.8%.

Cans were made which had a buckle strength of 97.7 psi (0.0118 inch gauge, NC-1 bottom profile design). This is strong for 55% cold reduction compared to the prior art because of increased solid solution hardening and possibly some precipitation hardening.

EXAMPLE 2

This example employed an aluminum alloy of the AA 5017 type having the following composition:

| Metal | Percent By Weight |
|---|---|
| Si | 0.30 |
| Fe | 0.40 |
| Cu | 0.26 |
| Mn | 0.77 |
| Mg | 1.88 |
| Al | Balance |

A cast strip having the foregoing composition was hot rolled from a thickness of 0.140 inches to 0.020 inches in two passes, beginning at a temperature of 1000° F. and exiting the hot rolling mill at 372° F. Immediately thereafter, the strip was heated to 1000° F. for three seconds, quenched and cold rolled to a thickness of 0011 inches.

The finish gauge stock was tensile tested, some stock being made into cups and can bodies. The earing was 2.1%. The tensile yield strength was 40,300 psi and the can buckle strength was 98.7 psi (0.0118 inch gauge).

EXAMPLE 3

A cast strip of alloy having the same composition as described in example 2 was hot rolled in three passes from 0.500 inches to 0.022 inches, beginning at 1000° F. and exiting from hot rollering at 335° F. The resulting strip was immediately heated without cooling for three seconds at 1000° F. quenched and cold rolled to 0.011 inches.

The earing was 2.0% and the tensile yield strength was 38,900 psi. Can buckle strength was 98.8 psi (0.0118 inch gauge).

EXAMPLE 4

This example illustrates the practice of the prior art and is provided for purposes of comparison.

Cast strip having the same composition as described in example 2 was hot rolled from 0.500 inches to 0.097 inches in two passes beginning at a temperature of 1000° F. and exiting at a temperature of 407° F. The alloy was then air cooled and heated at 700° F. using a one hour soak, air cooled, cold rolled to 0.020 inches, intermediate annealed at 700° F. using a one hour soak and cold rolled to 0.011 inches.

The finish gauge stock was tensile tested and some made into cups and can bodies. The earing was 2.3% and the tensile strength was 31,500 psi. The can buckle strength was unacceptably low at 76.6 psi (0.0118 inch gauge).

This example demonstrates that strength is lost when the solution heat treatment and quenching steps of the present invention are replaced with a conventional batch coil annealing cycle and cold working is limited to about 50% to maintain required earing, as in typical minimill practices.

EXAMPLE 5

An alloy having the following composition is used in this example:

| Metal | Percent By Weight |
|---|---|
| Si | 0.26 |
| Fe | 0.48 |
| Cu | 0.42 |
| Mn | 0.93 |
| Mg | 1.09 |
| Al | Balance |

Cast strip having the foregoing composition was hot rolled in two passes from 0.140 inches to 0.025 inches, starting at 1000° F. and exiting the hot rolls at 385° F. The strip was heated for three seconds at 1000° F. quenched and cold rolled to 0.011 inches.

In testing the sheet stock and cups and can bodies made therefrom, the earing was 2.8%, the tensile yield strength was 43.6 psi and the can buckle strength was 105.2 psi. This example illustrates the strengthening effect of increased copper content, enhancing the heat treatment effects. These properties are superior to conventional practice.

What is claimed is:

1. A method for manufacturing of aluminum alloy can body sheet comprising the following steps in a continuous, in-line sequence:

(a) providing an aluminum alloy hot can body feedstock;

(b) hot rolling the feedstock to hot reduce its thickness;

(c) annealing and solution heat treating the hot reduced feedstock without intermediate cooling while maintaining the temperature of the reduced feedstock for a time and level sufficient to retain alloying elements in solution; and (d) rapidly quenching the heat treated feedstock to a temperature for cold rolling.

2. A method as defined in claim 1 wherein the feedstock is provided by continuous strip or slab casting.

3. A method as defined in claim 1 wherein the feedstock is formed by depositing molten aluminum alloy on an endless belt formed of a heat conductive material whereby the molten metal solidifies to form a cast strip, and the endless belt is cooled when it is not in contact with the metal.

4. A method as defined in claim 1 which includes, as a continuous in-line step, cold rolling the quenched feedstock.

5. A method as defined in claim 3 or 4 which includes the further step of forming cups from the cold rolled sheetstock.

6. A method as defined in claim 3 or 4 which includes the step of coiling the cold rolled feedstock after cold rolling.

7. A method as defined in claim 6 wherein the coiling of the cold rolled sheetstock is in-line.

8. A method as defined in claim 5 wherein the cupping is carried out in-line.

9. A method as defined in claim 3 or 4 which includes the further step of forming in-line blanks from the cold rolled feedstock.

10. A method as defined in claim 3 or 4 which includes the further in-line step of shearing the cold rolled feedstock.

11. A method as defined in claim 1 wherein the hot rolling reduces the thickness of the feedstock by 40 to 99%.

12. A method as defined in claim 1 wherein the annealing and solution heat treating includes the in-line heating of the hot reduced feedstock to a temperature above the hot rolling exit temperature.

13. A method as defined in claim 12 wherein the hot reduced feedstock is heated to a temperature within the range of 750° up to the solidus temperature of the feedstock.

14. A method as defined in claim 1 wherein the annealing and solution heat treating is performed in-line at a temperature approximately the same as the hot rolling exit temperature for a period of time provided by a holding means.

15. A method as defined in claim 1 wherein the hot rolling of the feedstock is carried out at an exit temperature within the range of 300° F. to 1000° F.

16. A method as defined in claim 1 wherein the annealing and solution heat treating is carried out at a temperature within the range of 750° F. to the solidus temperature of the feedstock.

17. A method as defined in claim 1 wherein the hot rolling exit temperature is within the range of 300° to 1000° F.

18. A method as defined in claim 1 wherein the annealing and solution heat treating is carried out in less than 120 seconds.

19. A method as defined in claim 1 wherein the annealing and solution heat treating is carried out in less than 10 seconds.

20. A method as defined in claim 1 wherein the annealing and solution heat treated feedstock is quenched to a temperature less than 300° F.

21. A method as defined in claim 4 wherein the cold rolling step effects a reduction in the thickness of the feedstock of 20 to 75%.

22. A method as defined in claim 1 wherein the feedstock is an aluminum alloy containing from about 0 to 0.6% by weight silicon, from 0 to about 0.8% by weight iron, from 0 to about 0.6% by weight copper, from about 0.2 to about 1.5% by weight manganese, from about 0.8 to about 4% magnesium, from 0 to about 0.25% by weight zinc, 0 to 0.1% by weight chromium with the balance being aluminum and its usual impurities.

23. A method as defined in claim 1 wherein the aluminum alloy is selected from the group consisting of AA 3004, AA 3104 and AA 5017.

24. A method for manufacturing aluminum alloy can body sheet comprising the following steps in continuous, in-line sequence:

(a) strip or slab casting a can body aluminum alloy to form an aluminum alloy strip or slab;

(b) hot rolling said strip or slab to reduce its thickness;

(c) annealing and solution heat treating the hot reduced strip or slab without intermediate cooling while maintaining the temperature of the reduced feedstock for a time and level sufficient to retain alloying elements in solution;

(d) rapidly quenching said strip or slab to a temperature for cold rolling; and (e) cold rolling said strip or slab to produce can body sheet stock.

25. A method as defined in claim 24 which includes the further step of forming cups from the aluminum alloy strip.

26. A method as defined in claim 24 which includes the step of coiling the aluminum alloy strip after cold rolling.

27. A method as defined in claim 24 which includes the further in-line step of shearing the cold rolled aluminum alloy strip.

28. A method as defined in claim 1 wherein the width of the feedstock is less than 24 inches.

29. A method as defined in claim 24 wherein the width of the feedstock is less than 24 inches.

30. A method of manufacturing aluminum alloy can body sheet containing manganese, copper, magnesium and silicon comprising the following in-line sequence of steps:

(a) hot rolling the aluminum alloy can body sheet stock to reduce its thickness;

(b) annealing and solution heat treating the hot reduced feedstock; and (c) rapidly quenching the heat treated feedstock to a temperature for cold rolling, each of said steps being carried out continuously and in-line without intermediate cooling to minimize precipitation of alloying elements in the aluminum alloy.

* * * * *